United States Patent [19]

Kluiters

[11] 4,214,390

[45] Jul. 29, 1980

[54] PANEL ASSEMBLY

[76] Inventor: Gerard Kluiters, Tholenseweg 7, Amstelveen, Netherlands

[21] Appl. No.: 2,679

[22] Filed: Jan. 11, 1979

[51] Int. Cl.[2] ..... G09F 9/30; G09F 9/40

[52] U.S. Cl. ..... 40/447; 40/583; 428/138

[58] Field of Search ..... 40/447, 449, 503, 583, 40/579; 428/137, 138; 350/99

[56] References Cited

U.S. PATENT DOCUMENTS

| | | | |
|---|---|---|---|
| 2,429,379 | 10/1947 | Swain | 40/583 X |
| 2,903,806 | 9/1959 | Umanoff | 40/503 |
| 3,036,300 | 5/1962 | Knight | 40/449 X |
| 4,040,193 | 8/1977 | Matsuda et al. | 40/449 |

*Primary Examiner*—George F. Lesmes
*Assistant Examiner*—Alexander S. Thomas
*Attorney, Agent, or Firm*—Michael, Best & Friedrich

[57] ABSTRACT

A decorative panel assembly which includes a backing or supporting panel and a second or facing panel spaced from the backing panel. The facing panel includes a plurality of circular apertures therein and a plurality of spheres are loosely held hostage between the panels, the spheres each having a portion extending through the apertures. The spheres are supported such that they are each freely rotatable, and one hemispherical portion of each of the spheres is one color and the other hemispherical portion of each of the spheres is a contrasting color. The decorative panels may be used to form a wall or large decorative surface incorporating a large number of the rotatable spheres and whereby visual patterns can be formed by rotating the respective spheres such that the desired colored portion of the sphere surface projects through the respective aperture.

4 Claims, 3 Drawing Figures

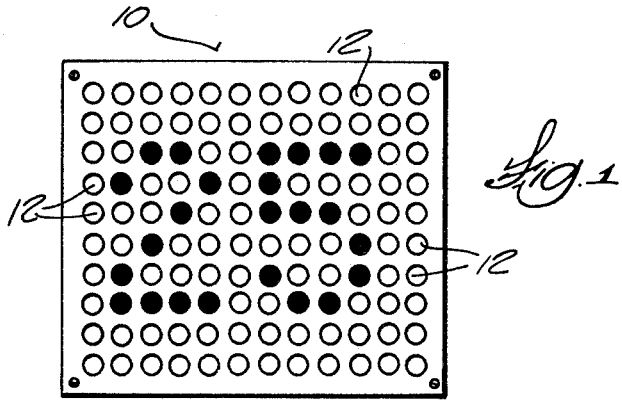
Fig. 1
Fig. 2
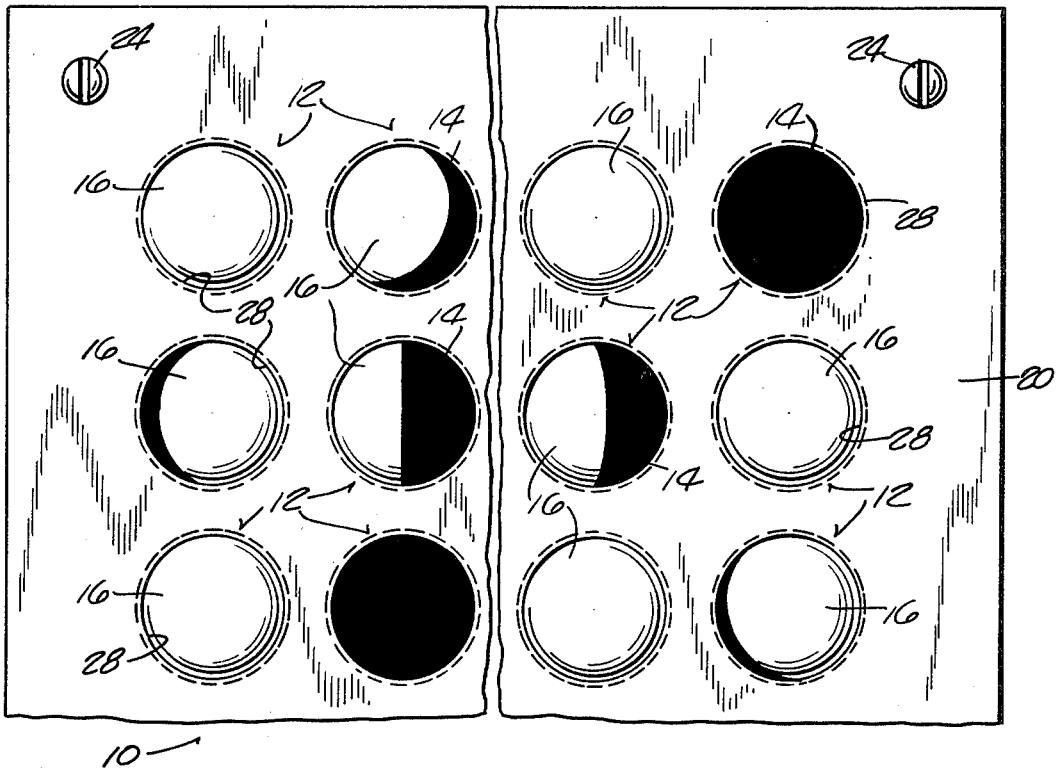
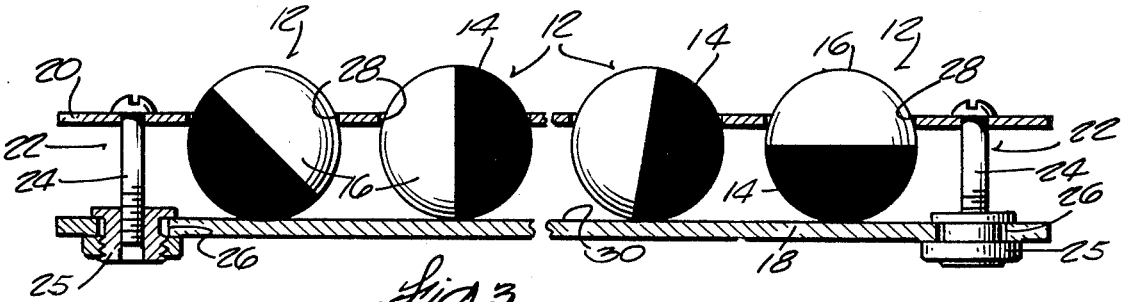
Fig. 3

PANEL ASSEMBLY

BACKGROUND OF THE INVENTION

The invention relates to panel assemblies such as decorative wall panels which include integral means for making a decorative design, and wherein the design may be easily changed by manipulation of those means.

SUMMARY OF THE INVENTION

The invention includes a panel assembly such as a decorative wall panel which includes means which can be manipulated whereby a colored pattern or display can be formed and whereby the pattern can be easily changed by subsequent manipulation.

More particularly, the invention includes a panel assembly formed by a first panel and a second panel supported in spaced relation from the first panel, and the second panel including a plurality of apertures therein. A plurality of spheres or balls are housed between the panels with a portion of each of the spheres projecting through the apertures. One hemispherical portion of each of the spheres is one color and the other hemispherical portion of each of the spheres is a contrasting color. The spheres can be rotated to display various colors through the apertures and the spheres of the panel assembly can be manipulated to form various designs. The spheres are supported generally loosely between the panels such that they are easily rotated or manipulated. Accordingly, modification of the design or configuration presented by the spheres can be quickly and easily changed.

Various other features of the invention are set forth in the following description, in the drawings and in the claims.

BRIEF DESCRIPTION OF THE DRAWINGS

FIG. 1 is a plan view of a portion of a decorative panel assembly embodying the present invention.

FIG. 2 is an enlarged partial plan view of the decorative display panel portion shown in FIG. 1.

FIG. 3 is a cross-section elevation view of the panel shown in FIG. 2. Before explaining the invention in detail, it is to be understood that the invention is not limited in its application to the details of construction and the arrangement of the components set forth in the following description or illustrated in the drawings. The invention is capable of other embodiments and of being practiced and carried out in various ways. Also, it is to be understood that the phraselogy and terminology employed herein are for the purpose of description and should not be regarded as limiting.

DESCRIPTION OF THE PREFERRED EMBODIMENT

Illustrated in FIG. 1 is a decorative panel assembly 10 embodying the present invention and generally including means for supporting a large number of freely rotatable spheres 12 in such a manner that a portion of each sphere is visible to an observer looking at the panel. In one preferred embodiment of the invention, one hemispherical surface 14 of each of the spheres is one color and the other hemispheral surface 16 of the spheres 12 is a different or constrasting color. The spheres are independently supported and are freely and independently moveable or rotatable so that different portions of their surfaces can be made to be visible, i.e. face the observer. As shown in FIG. 1, such manipulation of the spheres can be employed to form letters, numbers, designs or artistic configurations.

Whereas the decorative panel assembly illustrated in FIG. 1 is shown as being relatively small, it should be understood that the invention encompasses uses of similar panels of sufficient size to be employed, for purposes of example, as decorative walls wherein the spheres 12 can be manipulated by hand so as to form a decorative display. As an example of the various other uses of the invention, a large panel embodying the invention could be used in public areas as a vehicle for graphiti or in residences or commerical establishments as a decorative display device. The panels could also be employed in advertising functions to form billboards, marquis and the like wherein the spheres of the panel assemblies could be manipulated so as to form a series of letters or numbers. The panel assembly so employed provides an advertising device which is relatively inexpensive to manufacture and which can be quickly and easily changed to display a different concept.

Another preferred use of the invention is in childrens games whereby, for example, a more compact and smaller panel having relatively small spheres could used by children in forming pictures, letters or numbers. The invention could similarly be used as a testing tool for testing ability to express concepts visually and for testing dexterity or motor skills.

It should also be understood that whereas the spheres 12 illustrated in the drawings have a size like that of a ping pong ball, the spheres could have any of a variety of sizes and could, for example include very small spheres positioned in closely adjacent relation. It should also be recognized that while the spheres illustrated in the drawings are aligned in mutually perpendicular rows, other configurations and patterns of spheres could also be employed. Additionally, though the panel asembly 10 is illustrated as being planar, it could also have a curved configuration.

Furthermore, while in the preferred embodiment the spheres have only two colors and all of the spheres are colored identically, in alternative embodiments the spheres could have more than two colors and the spheres could be colored different colors. The spheres could also be printed with numbers, characters, symbols or figures so that the panel assembly could be used as a calendar or the like.

Referring now more particularly to the structure shown in the drawings, the panel assembly 10 is comprised of a first supporting planar panel 18 (FIG. 3) and a second or facing planar panel 20 is supported in parallel spaced relation from the first panel 18. The second panel 20 is supported by a plurality of spacer members 22 comprising, for example, bolts 24 extending through the spaced panel 20 and threadably housed in a bushing 25 journaled in a bore 26 in the first panel 18. The second panel 20 includes a large number of circular apertures 28 therethrough and the spheres 12 are held hostage between the facing surface 30 of the first panel 18 and the second panel 20 with a portion of the spheres 12 projecting through the apertures 28 in the second panel, and with the spheres 12 being loosely held in the apertures and being freely rotatable. Described alternatively, the apertures 28 in the facing panel are large enough to receive a substantial portion of the spheres 12 therethrough but are smaller than the diameter of the spheres, and the second panel 20 is spaced from the facing surface of the support panel 18 by a distance less than that of the diameter of the spheres.

Various features of the invention are set forth in the following claims.

I claim:

1. A decorative panel assembly comprising a first panel, a second panel including a plurality of apertures therethrough, means for supporting said second panel in spaced parallel relation from said first panel, and a plurality of spheres housed between said first panel and said second panel, said spheres being freely rotatably supported in said apertures by a surface of said first panel and by the peripheries of said apertures in said second panel and for universal rotation in any direction to permit any surface portion of the spheres to be exposed through said apertures, and said spheres each including a portion projecting through said apertures, and at least a plurality of said spheres each having a portion of its external surface being one color shade and another portion of its external surface being another color shade, said spheres being adapted to be rotated manually.

2. A decorative panel assembly as set forth in claim 1 wherein said apertures are circular and wherein said spheres have a diameter greater than that of said apertures.

3. A decorative panel as set forth in claim 1 wherein said spheres each include one hemispherical surface portion colored one color and the other hemispherical surface portion colored a contrasting color.

4. A decorative panel as set forth in claim 1 wherein said spheres are all substantially the same size, and wherein said second panel is spaced from said first panel by a distance less than the diameter of said spheres.

* * * * *